United States Patent [19]

Curtis

[11] Patent Number: 4,632,715

[45] Date of Patent: Dec. 30, 1986

[54] LOW BURN RATE MOTOR PROPELLANT

[75] Inventor: Donald D. Curtis, San Jose, Calif.

[73] Assignee: The United States as represented by the Secretary of the Navy, Washington, D.C.

[21] Appl. No.: 807,429

[22] Filed: Dec. 10, 1985

[51] Int. Cl.[4] ..... C06B 45/10

[52] U.S. Cl. ..... 149/19.5; 149/19.9; 149/21; 149/92; 149/111

[58] Field of Search ..... 149/19.5, 19.9, 21, 149/92, 111

[56] References Cited

U.S. PATENT DOCUMENTS

| | | | |
|---|---|---|---|
| 3,177,101 | 4/1965 | Vriesen | 149/19 |
| 3,649,389 | 3/1972 | Barron | 149/19 |
| 3,725,154 | 4/1973 | McCulloch et al. | 149/19 |
| 3,834,957 | 9/1974 | McDevitt et al. | 149/19 |
| 3,948,698 | 4/1976 | Elrick et al. | 149/19.9 |
| 3,982,975 | 9/1976 | Elrick et al. | 149/19.9 |
| 3,984,265 | 10/1976 | Elrick et al. | 149/19.9 |
| 4,116,734 | 9/1978 | Perrault et al. | 149/19.9 |
| 4,241,661 | 12/1980 | Elrick et al. | 149/19.9 |
| 4,337,103 | 6/1982 | Elrick et al. | 149/19.9 |
| 4,415,728 | 11/1983 | Tremblay | 149/19.4 |
| 4,430,131 | 2/1984 | Tremblay | 149/19.4 |

FOREIGN PATENT DOCUMENTS 1283691 8/1972 United Kingdom .

*Primary Examiner*—Stephen J. Lechert, Jr.

*Attorney, Agent, or Firm*—R. F. Beers; C. D. B. Curry; S. G. Precivale

[57] ABSTRACT

A low burn rate motor propellant containing hydroxyl terminated polybutadiene, HMX and hexanedioldimerate polymer.

8 Claims, No Drawings

LOW BURN RATE MOTOR PROPELLANT

FIELD OF THE INVENTION

This invention relates to motor propellants. More particularly, this invention relates to motor propellants having a low burn rate. Still more particularly but without limitation thereto, this invention relates to the addition of hexanedioldimerate polymer to a hydroxyl terminated polybutadiene/HMX propellant.

DESCRIPTION OF THE PRIOR ART

Various techniques have been attempted in the prior art to modify propellant burn rates, in the present instance, for a high solids hydroxyl terminated polybutadiene/cyclotetramethylene tetranitramine (HTPB/HMX) propellant. However, despite the development of the art, there has remained a continuing need for improved techniques of balancing the need for a high burn rate for propulsion purposes and the need for a low burn rate for idle purpose so as to conserve fuel. Therefore, it is desirable to have a propellant which will provide control and demand thrust when required and which will conserve fuel when thrust is not needed.

SUMMARY OF THE INVENTION

An object of the present invention is to provide a propellant with a modified burn rate.

A further object of this invention is to provide a propellant which has a low rate of combustion possible without extinguishment.

These and other objects have been demonstrated by the present invention wherein hexanedioldimerate polymer is added to high solids HTPB/HMX propellant to enable reduction of the burn rate to achieve on demand very low burn rates for propellant fuel conservation and high burn rates for thrusting.

DESCRIPTION OF THE PREFERRED EMBODIMENT

The present invention encompasses a technique of combining a low oxygen content polymer, hexanedioldimerate (HDD), with the extremely age stable HTPB polymer with HMX monopropellant in the 85.3% solids range. This is a previously unknown method of burn rate modification for the basic 3000° F. high energy HTPB/HMX propellant formulation.

This invention offers a propellant formulation with low burning rates at low pressures, excellent low pressure combustion stability and theoretical impulse comparable to state of the art propellants. Further, this propellant provides for a propellant which can be manufactured to give good flow characteristics and provide void free motors.

Hexanedioldimerate polymer (HDD) is a polyester originating from the reaction product of hexanediol and 10-10 dimer acid, a $C_{36}$ dibasic acid having the following structure:

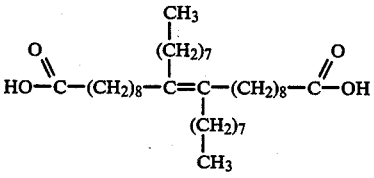

HDD has the following structure:

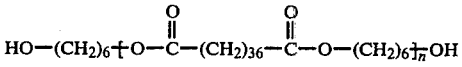

where n is approximately 3.

Studies have been made to isolate the factors which strongly affect the magnitude of the burning rate of HTPB/HMX propellants. These studies indicate two processing variables which show strong correlations to the burning rate: the oxygen content of the binder and the propellant modulus. The burning rate decreases as the oxygen content increases and also as the modulus increases.

As for HDD, it contains approximately 12 weight percent oxygen and this along with the binder oxygen and short chain carbon fragments resulting from HDD degradation, acts to suppress the HMX decomposition rate thereby lowering the propellant burn rate. The increased oxygen content of the binder acts to lower the burn rate because since the binder is partially oxidized, less energy is released in the combustion process particularly at the surface where the burning rate is affected.

The modulus increases as the amount of crosslinking increases. Being a hydroxyl terminated material, HDD contributes to the binder network in a manner similar to that of hydroxyl terminated polybutadiene (HTPB). It is postulated that chemical linkages derived from the crosslinking require more energy to break the bonds during the combustion process. Thus effective "loss in energy" thereby results in less energy available for the surface processes and hence for driving the burning rate. Further, since HDD is part of the binder and must compete for isocyanate groups with HTPB, its reaction rate with isocyanate is of considerable interest. HDD reacts twice as fast as HTPB in consuming —NCO groups. Therefore, HDD is definitely "tied in" to the binder network to perform as a rate suppressant and combustion stabilizer.

Hexanedioldimerate polymer has the following physical properties:

| | |
|---|---|
| Equivalent weight | 1050 g/eq |
| Moisture content | <0.1% |
| Acid number | <0.02 meq/g |
| Molecular weight ($M_n$) | 1990–2630 |
| Polydispersity | 1.90 |

As with many oxygenated polymers, HDD has some affinity for moisture. However, stripping HDD at an elevated temperature (80° C.) under vacuum (≦2 mmHg) significantly lowers the polymer moisture content to acceptable levels.

Thermal analysis of HDD at 110° C. (230° F.) indicates that the polymer is thermally stable, i.e. the polymer possesses good shelf life and aging characteristics, thereby making it an acceptable material for propellant applications since the propellant processing characteristics are directly related to the physical properties of the HDD polymer.

It has been determined that optimum performance is achieved by combining HDD and HTPB in a 1:1 weight ratio. Typically, the propellant of this invention will have about 85.3 weight percent solids (HMX) and about 14.7 weight percent HDD/HTPB. If desired, about 0.05 weight percent carbon black can be added, bringing the total solids to 85.35% and the total polymer to 14.65%. Commercially available carbon black sold by Cabot Corporation (New Jersey), under the tradename "Elftex 8" has proven to be suitable.

A serious concern which affects propellant processing characteristics is the end of mix viscosity. It is desirable to minimize viscosity as much as possible in order to facilitate processing. This is achieved in part by holding the propellant mix overnight at 170° F. prior to addition of the curative. In this manner, the wetting of the HMX is improved which significantly reduces the propellant viscosity and improves the propellant potlife characteristics.

More specifically, the end of mix viscosity can be controlled by varying the particle size of the HMX used so as to have a mixture of coarse HMX (average mean diameter≅150μ) and fine HMX (average mean diameter≅13μ). The ratio of coarse to fine HMX is preferably within the range of 60:40 to 75:25. A particularly preferred ratio of coarse to fine is 70:30, which yields the lowest end of mix viscosity.

The propellant mix is cured by means of an isocyanate curative, preferably isophorone diisocyanate. As for the cure itself, the propellant achieves near equilibrium cure after 7 days at 170° F. At this point, the propellant possesses a high stress (172 psi) and good strain capability (19% at maximum stress).

The preferred embodiment of this invention has 85.35 weight percent solids (85.3% HMX and 0.05% carbon black) and 14.65 weight percent polymer equal parts by weight of HDD and HTPB), and exhibits the following properties:

| | |
|---|---|
| End of mix viscosity, kp | 55 |
| Propellant performance, lbf-sec/lbm | 257.9 |
| Flame temperature, °F. | 3058 |
| Burning rate @ 100 psia, in/sec | 0.030 |
| Burning rate @ 200 psia, in/sec | 0.046 |
| Burning rate @ 500 psia, in/sec (extrapolated) | 0.081 |
| Pressure exponent, % | 0.62 |

The presence of carbon black does not influence performance, processing or the burning rate at low pressures of the propellant. However, since the burning rate versus the pressure relationship (logarithmic) indicates that a slightly higher pressure exponent occurs with the inclusion of carbon black, the preferred embodiment utilizes a small amount of carbon black, about 0.05 weight percent.

The inventive concept of incorporating hexanedioldimerate polymer into an HTPB/HMX propellant having good pressure stability, excellent low pressure combustion characteristics, low burning rates, especially at 100 psia and an acceptably high pressure exponent (≅0.6%). The burn rate equation is $r=aP_c^n$ where:

r=burn rate, in/sec a=constant, in/sec-psia $P_c$=chamber pressure, psia n=pressure exponent The pressure exponent is the slope of the burn rate versus chamber pressure curve and can vary from 0 to 1. Boost motor propellant designs aim for a low exponent, less than 0.15. Experience indicates that when "n" is greater than or equal to 0.85, planned burn rates and operating pressures are uncontrollable and enter a runaway condition. Having an "n" value within the range of 0.5 to 0.85, as is the case with this invention, offers capability for "on demand" changes to the burn rate.

The foregoing description has been set forth merely to illustrate the invention and is not intended to be limiting. Since modifications of the described embodiments incorporating the spirit and substance of the invention may occur to persons skilled in the art, the scope of the invention should be limited solely with respect to the appended claims and equivalents.

What is claimed is:

1. A low burn rate motor propellant comprised of hexanedioldimerate polymer, hydroxyl terminated polybutadiene and cyclotetramethylene tetranitramine.

2. The propellant of claim 1 wherein said hexanedioldimerate and said hydroxyl terminated polybutadiene are present in a 1 to 1 weight ratio.

3. The propellant of claim 1 wherein the composition by weight is about 85.3% cyclotetramethylene tetranitramine and about 14.7% hexanedioldimerate polymer/hydroxyl terminated polybutadiene.

4. The propellant of claim 1 which further comprises carbon black.

5. The propellant of claim 4 wherein the composition by weight is about 85.3% cyclotetramethylene tetranitramine, about 14.65% hexanedioldimerate/hydroxyl terminated polybutadiene and about 0.05% carbon black.

6. The propellant of claim 1 wherein said HMX is a mixture of fine and coarse cyclotetramethylene tetranitramine particles, wherein said fine particles have an average mean diameter of about 13μ and said coarse particles have an average mean particle diameter of about 150μ.

7. The propellant of claim 6 wherein the ratio of coarse to fine particles is within the range of 60:40 to 75:25.

8. The propellant of claim 7 wherein the ratio of coarse to fine particles is about 70:30.

* * * * *